US006234790B1

(12) United States Patent
Van Laar et al.

(10) Patent No.: US 6,234,790 B1
(45) Date of Patent: May 22, 2001

(54) REFRACTORY WALL STRUCTURE

(75) Inventors: Jacobus Van Laar, Driehuis; Gerardus Gleijm, Ijmuiden; Cornelis Pieter Teerhuis, Marken; Hisko Leon Toxopeus, Heiloo, all of (NL)

(73) Assignee: Corus Staal B.V., IJumiden (NL)

( * ) Notice: Subject to any disclaimer, the term of this patent is extended or adjusted under 35 U.S.C. 154(b) by 0 days.

(21) Appl. No.: 09/424,778

(22) PCT Filed: May 28, 1998

(86) PCT No.: PCT/EP98/03194

§ 371 Date: Feb. 9, 2000

§ 102(e) Date: Feb. 9, 2000

(87) PCT Pub. No.: WO98/54367

PCT Pub. Date: Dec. 3, 1998

(30) Foreign Application Priority Data

| | | |
|---|---|---|
| May 30, 1997 | (NL) | 1006169 |
| Jul. 31, 1997 | (NL) | 1006693 |
| Aug. 8, 1997 | (NL) | 1006738 |

(51) Int. Cl.[7] ..... F27D 1/00

(52) U.S. Cl. ..... 432/247; 432/248; 432/252; 266/280; 266/286

(58) Field of Search ..... 432/247, 248, 432/252; 266/280, 286, 197, 193; 52/506.02, 406.3

(56) References Cited

FOREIGN PATENT DOCUMENTS

| | | | |
|---|---|---|---|
| 1944415 | * | 4/1971 | (DE) . |
| 0149575 | * | 7/1985 | (EP) . |
| 2429985 | * | 1/1980 | (FR) . |
| 2558173 | * | 7/1985 | (FR) . |
| 7510905 | * | 3/1977 | (NL) . |

* cited by examiner

*Primary Examiner*—Jiping Lu
(74) *Attorney, Agent, or Firm*—Stevens, Davis, Miller & Mosher, LLP

(57) ABSTRACT

Refractory wall structure for a blast furnace, in particular for a metallurgical furnace, such as for example a blast furnace with a high process temperature during operation, which wall structure is subjected to a high thermal loading. The wall structure comprises a steel outer wall, a refractory lining consisting of one or more layers of a well heat-conducting material on the inside of the outer wall, and a cooler for cooling the refractory wall structure, whereby the wall structure also comprises a permanent, well heat-conducting metallic filling in a gap in the refractory wall structure, which filling has been molten inside the gap and then after solidifying forms a low heat resistance across the gap.

44 Claims, 3 Drawing Sheets

REFRACTORY WALL STRUCTURE

FIELD OF THE INVENTION

The invention relates to a refractory wall structure for a furnace, in particular for a metallurgical furnace, such as for example a blast furnace with a high process temperature during operation, which wall structure is subjected to a high thermal loading, comprising a steel outer wall, a refractory lining consisting of one or more layers of a well heat-conducting material on the inside of the outer wall, and means for cooling the refractory wall structure.

BACKGROUND OF THE INVENTION

With the wall structure of this furnace, the refractory lining is exposed to a high temperature. As a consequence of this, considerable wear of the refractory lining occurs and its service life is reduced. At the state of the art the reference temperature is kept low by cooling and attempts are made to keep the interior temperature low by using refractory materials with a high heat conductivity, such as graphite, semi-graphite or other refractory materials containing graphite. The means for cooling the refractory wall structure can consist of means on the outside of the steel wall, such as for example spray-cooling, air-cooling or cooling ducts for fluid coolants, or of other means on the inside of the steel wall such as for example water-cooled cooling elements such as stave coolers or cooling plates which are generally made from copper.

SUMMARY OF THE INVENTION

The object of the invention is to reduce the wear of this wall structure and to improve the service life.

The object of the invention is also to create a repair process for the refractory wall structure of a furnace which prolongs the service life.

With the invention this is achieved because the wall structure also comprises a permanent, well heat-conducting metallic filling in a gap in the refractory wall structure, which filling has been molten inside the gap and then after solidifying forms a low heat resistance across the gap.

The invention relies on the notion that the gaps which inevitably occur or form in the refractory wall structure which is always of a composite nature, form considerable heat resistances for the flow of dissipating heat passing through, so that the interior temperature of the refractory lining remains high. The filling, which in molten state has a close thermal contact with the gap walls, which contact remains unchanged following solidification, and the good heat conductivity of the material of the filling, together provide a low heat resistance across the gap, so that the interior temperature of the refractory lining falls. In certain cases, a layer such as slag can even solidify onto and build up on the inside. This results in a permanent, wear-resistant layer.

In WO95/22732 a construction of a wall lining for a furnace is described in which high thermal conductivity elements extend from a cooled metal outer shell into a refractory lining. These elements may themselves consist of a refractory material of which the pores have been impregnated with a metal. This patent application does not deal with the reduction of heat barriers which are formed by gaps between refractory bricks or between elements and refractory bricks.

Preferably the gap with a good heat conducting metallic filling is a gap in the refractory lining, or a gap between the steel outer wall and the refractory lining, or, if the means for cooling the refractory wall structure are water-cooled copper cooling elements, a gap between the refractory lining and a cooling element. A gap in the refractory lining can be a gap between two layers of the refractory lining, or a gap between two elements such as blocks or bricks of the refractory lining, or a gap such as a heat crack in the material of the refractory lining. The most effective are fillings in gaps which lie at right-angles to the flow of heat, so that the heat resistance for the heat dissipation is reduced.

The melting temperature of the metallic filling is preferably lower than the process temperature, higher than 200° C. and lower than 1,100° C. and the filling has a coefficient of heat conductivity of over 15 W/m ° C.

The filling is preferably selected from the group consisting of tin, lead, zinc, aluminium, silver, copper and alloys of these and combinations of these.

Preferably the filling is obtained during operation by melting of foil which is applied in the gap during assembly of the refractory wall structure, the filling is cast into the gap in molten state during assembly or the filling is obtained during operation by melting a metal which is applied in the gap in the form of a mass containing metal particles during assembly of the refractory wall structure. These embodiments of the invention are all very effective.

The embodiment with a mass containing metal particles is also suitable for wider gaps such as joints which are normally filled up with mortar, concrete, ramming mass, cement or other binding agents such as for example the joint between jacket (1) and graphite layer (3') in FIG. 2. Metal particles in the form of powder, grains, granulated material, chips, needles, small wires or similar are added to this mass. This metal-laden mass is applied in a joint during assembly of the refractory wall structure. In this state the metal particles are evenly divided present in the relevant joint, but still do not form a heat bridge over the joint. Following melting and solidification again of the metal, however, the joint is not homogeneously filled with metal but at sufficient loading of the mass with metal particles of for example 10–40% vol a continuous metal lattice with a spongy or biscuit-like structure forms throughout the joint with a low heat resistance owing to the good heat conductivity of the metal and thus forms a heat bridge.

Also preferably the filling is obtained during operation by melting metal in the form of one or more pellets which are placed into one or more cavities in the refractory wall structure before or after the start of the operation of the furnace. In some cases in an alternative embodiment pellets can also be applied during operation. In this context pellets are taken to be a form of the filling which can be applied into the cavity singly or in multiples, such as tablets of round, oval or cylindrical shape, but also shaped parts which fit into the cavity, or for example in rod-shaped pieces in the case where they are applied subsequently during operation. Capsules with a dosing opening are also possible so that the filling is discharged over a longer period of time or several times, for example where the refractory wall structure breathes in the event of temperature fluctuations.

Preferably the filling is obtained during operation by melting metal which is introduced in the form of a pumpable mass containing the metal into the refractory wall structure through a duct. The pumpable mass can for example be a slurry or a suspension, which is laden with the metal in finely divided state such as powder or grains to such an extent, for example 10 to 60% wt, that it does not sag. Preferably the pumpable mass also contains an oil product such as tar or pitch or a thermosetting resin as a carrier and the pumpable mass also contains graphite for example in the form of powder. Mortar and cement can also be added. After the pumpable mass has been introduced into the gap by pumps the metal melts and forms a heat bridge over the gap. Following coking the tar or the pitch forms a skeleton which for example effects a certain gas tightness of the gap. The same effect can be obtained by the resin following setting, while the graphite can yield extra wear resistance and/or heat conduction of the refractory wall structure. The embodiments of the invention with pellets and with a pumpable mass are particularly suited to be applied after starting the operation of the furnace.

Preferably during assembly of the refractory wall structure cooling elements are used which, at least partly, have been provided with a coating with the substance of the metallic filling. By a coating here is understood a layer which during its application has obtained a good heat-transfer contact with the cooling element.

For instance the coating can have been applied by melting a layer of the substance upon the cooling element, by immersing the cooling element in a melt of that substance, by electrodeposition or by spraying.

The aforementioned embodiments of the invention can be combined with each other. Thus, the embodiment for example whereby a mass containing metal particles is applied in a gap during assembly, can ideally be combined with application of a pumpable mass in that gap after starting the operation.

In another aspect the invention is embodied in a method for repairing a blast furnace during operation with a refractory wall structure in accordance with claim 1, comprising a steel outer wall (jacket), a refractory lining (brickwork) and means for cooling the refractory wall structure comprising the stages during operation drilling a duct through the steel outer wall and into the refractory lining extending into or past a gap in the refractory wall structure during operation introducing into the duct a metal with a melting point in the vicinity of the instantaneous temperature at the gap. Preferably the metal is introduced in the form of one or more pellets or in the form of a pumpable mass containing the metal, by pumps. In a preferred embodiment, whereby the means for cooling the refractory wall structure comprise stave coolers, recesses are left in the stave coolers through which during operation a duct may be drilled.

BRIEF DESCRIPTION OF THE DRAWINGS

The invention will now be illustrated by reference to the drawing.

DETAILED DESCRIPTION OF THE PREFERRED EMBODIMENTS

Figure 1:
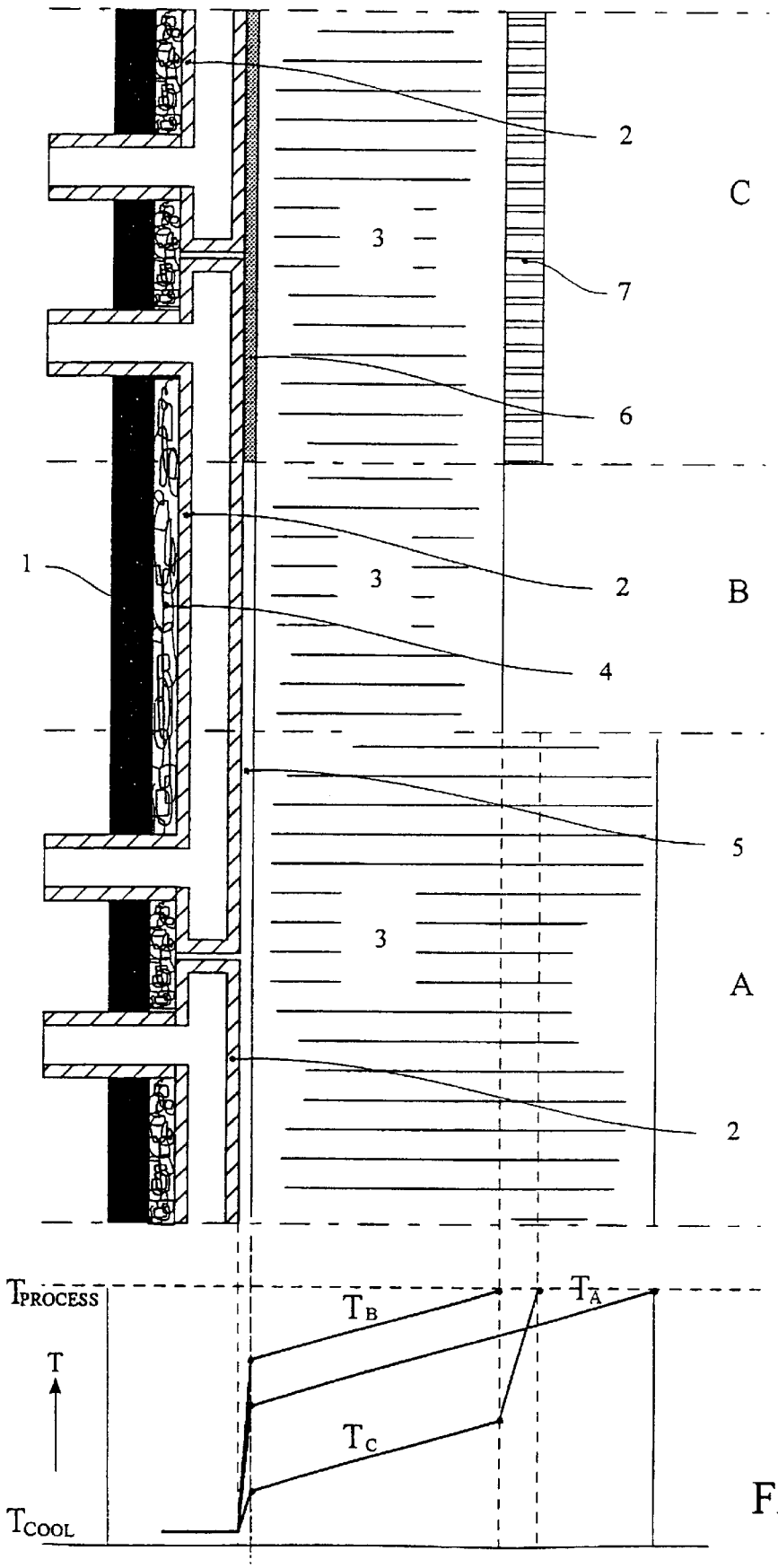
FIG. 1 shows a refractory wall structure in accordance with the invention in a general embodiment in different stages of wear together with the associated temperature curve.

The refractory wall structure of FIG. 1 comprises a steel outer wall (1), means of cooling in the form of water-cooled, copper stave coolers (2) and a well heat-conducting refractory lining (3), for example of graphite. The space between the steel outer wall and the stave coolers (2) is filled up with for example mortar (4).

The situation directly following starting the operation of the furnace is indicated by A, whereby no wear has yet occurred and the refractory lining (3) still has its original thickness. The associated temperature curve is indicated by $T_A$ in the bottom part of FIG. 1. $T_{process}$ indicates the process temperature and $T_{cool}$ indicates the reference temperature of the cooling. The figure shows that a considerable fall in temperature occurs across the gap (5) between stave coolers (2) and refractory lining (3) as a result of the high heat resistance of gap (5). As shown in FIG. 1, the gap (5) is basically (in other words, substantially) paralled to steel outer wall (1).

The situation after the furnace has been in operation for some time is indicated by B. The refractory lining (3) is partly worn away as a result of the high temperature and the corrosive conditions. In particular slag containing FeO is especially corrosive. $T_B$ indicates the temperature curve. As a result of the reduced thickness of refractory lining (3), the total heat transmission resistance of the wall structure has reduced, and the heat flow density has increased through the wall structure. This results in a steeper temperature curve across the residual thickness of refractory lining (3) and a greater temperature drop across gap (5). If the process of wear is allowed to continue then refractory lining (3) becomes further consumed and the risk of breakthrough increases.

C indicates the situation with a metallic filling (6) in gap (5) which filling has been molten and therefrom continues to maintain a good thermal contact with the gap walls. In this case the filling is a low melting point metal such as for example a tin alloy. $T_C$ shows that, as a result of the low heat resistance of the filling, the temperature drop across gap (5) is much less. The temperature of refractory lining (3) falls so that a slag layer (7) can solidify, which of itself does not conduct heat well, so that a big temperature drop occurs across it, but which protects the residual thickness of refractory lining (3) from further wear. Filling (6) can be cast into gap (5) during assembly of the refractory wall structure or be applied there as a film which in situation B will melt.

Figure 2:
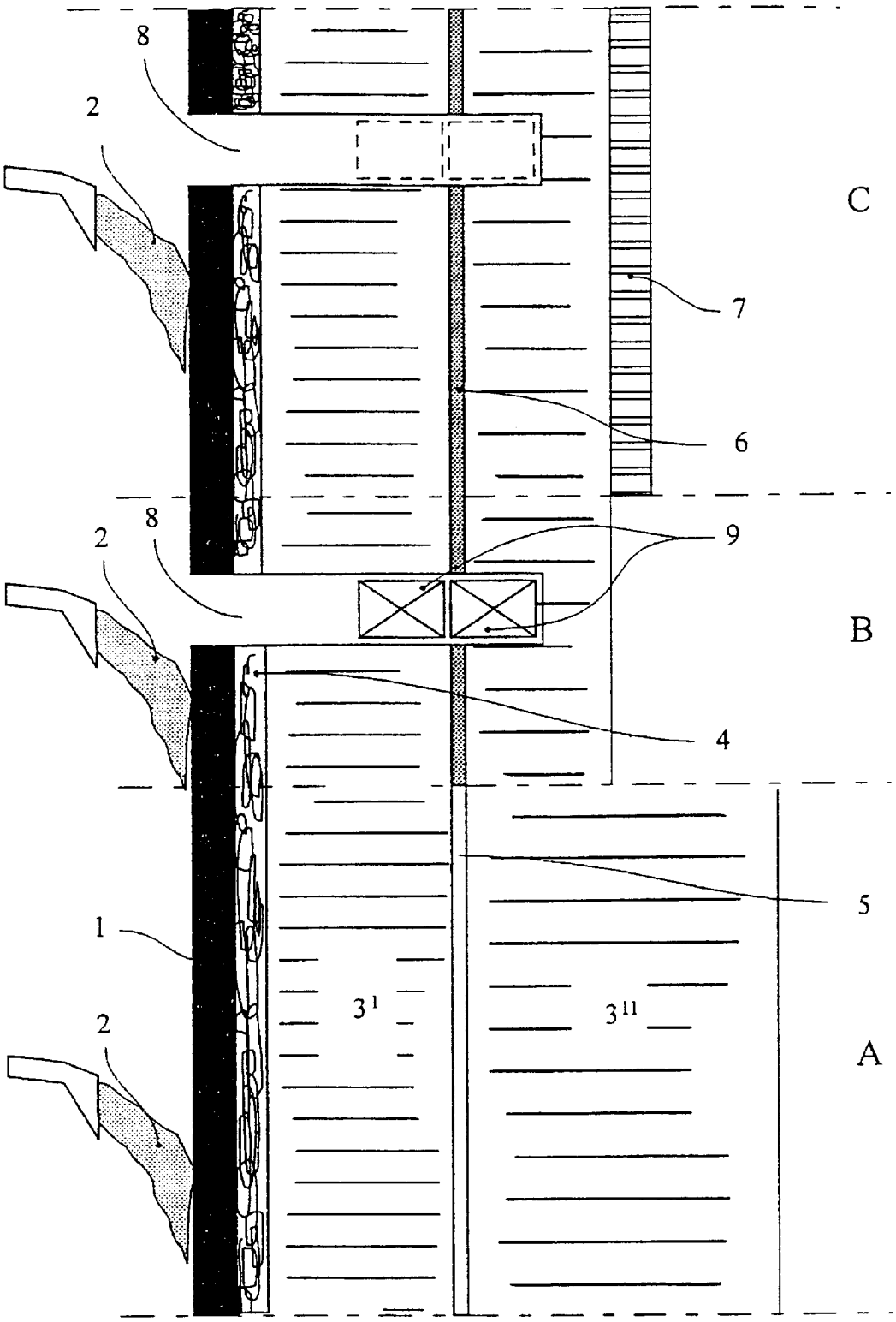
FIG. 2 shows as example of the invention a refractory wall structure for a hearth of a blast furnace.

FIG. 2 shows the invention applied to the hearth of a blast furnace. Jacket (1) is cooled on the outside by means of spray-cooling (2). In the case shown here, refractory lining (3) consists of two layers, namely layer (3') of graphite and a layer (3") of semi-graphite. A ramming compound of graphite is applied in gap (5) between layers (3') and (3"). Situations A and B are analogous to that of FIG. 1. In situation B a considerable part of inner coating layer (3") has worn away and a considerable temperature drop is occurring across gap (5). As shown in FIG. 2, the gap (5) is bascially (in other words, substantially) paralled to the outer wall (1).

The figure shows how in situation B the wall structure is repaired after the start of the operation and during operation. To this end ducts (8) are drilled through jacket (1), mortar layer (4) and refractory lining layer (3'), which ducts (8) extend into or past gap (5) between lining layers (3') and (3"). In general drilling cannot take place during the production of pig iron because the furnace is under pressure. Therefore the holes are drilled during operation but during a so-called standstill or maintenance stop whereby the production of pig iron is interrupted and whereby the hot blast is switched off and the pressure falls out. At a new furnace, however, the ducts can already be made wholly or partly during assembly of the refractory wall structure. Following drilling one or more pellets (9) of a metal with a melting point in the vicinity of the instantaneous temperature at the gap are introduced into the holes. Once the ducts have been drilled this temperature may be measured and the metal selected accordingly. In this case the metal can be an alloy of aluminium or copper. When pellets (9) melt the metal runs into gap (5). The reduced heat resistance of gap (5) makes the temperature drop fall across gap (5), and the temperature of the outer lining layer (3") falls. Filling (6) solidifies and slag layer (7) can solidify and build up. Of course pellets (9) can also be placed in suitable places in the refractory wall structure prior to the operation of the blast furnace. If pellets are placed through such ducts as (8) or similar then these ducts may of course be filled in and sealed (possibly temporarily) after the pellets have been placed.

In another embodiment the ducts (8) can be provided with nipples (not shown) on the outside of the jacket (1) to which a pressure pipe is connected, through which a pumpable mass containing the metal can be pressed into the ducts (8). The mass then spreads over the gaps in the refractory wall structure and following melting etc. forms heat bridges over the gaps. Contrary to drilling pumping can take place at a furnace under pressure.

Figure 3:
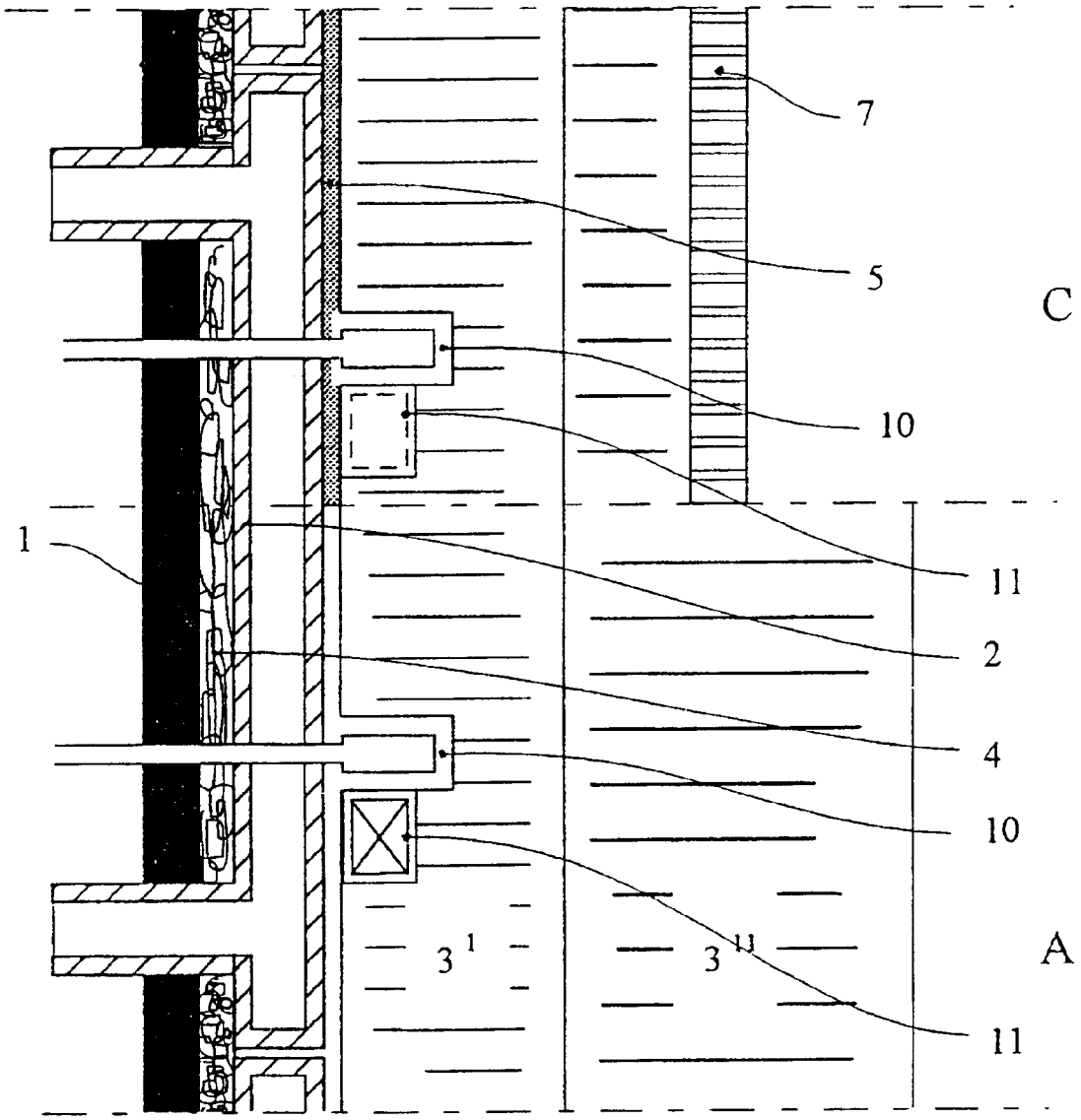
FIG. 3 shows as example of the invention a refractory wall structure for a final reduction vessel of a smelting reduction process.

FIG. 3 shows an invention applied to a final reduction vessel for a smelting reduction process, for example of the deep slag type such as for example the Cyclone Converter Furnace (CCF) process. The thermal loading here is especially high. Consequently in FIG. 3 not only are stave coolers (2) used, but also water-cooled copper sills (10) which extend into the refractory lining and which serve to improve the heat contact between the refractory lining and the means of cooling (2), (10). Refractory lining (3) consists of at least a layer (3') of graphite. The means of cooling (2), (10) limit the possibilities of applying pellets afterwards, that is to say during operation. Consequently in this case it was decided to apply pellets (9) during the assembly of the refractory wall structure into suitable cavities (11) in the refractory wall structure, which pellets fill gap (5) as they melt on commissioning, or once refractory lining (3) has partly worn away. The cavities may also be made for example directly above sills (10). There is also the possibility to let recesses into the stave coolers through which a duct can be drilled during operation. As shown in FIG. 3, the gap (5) is basically (in other words, substantially) parallel to the steel outer wall (1).

Finally there is the possibility to use, during the assembly, cooling elements which on the side directed to gap (5) have been coated. The low heat-resistance across the gap (5) can be achieved already during the assembly, by assembling the refractory lining (3) while, at least at the side facing the gap, being heated such that the filling melts.

A low heat resistance can, however, also be obtained later during the operation.

What is claimed is:

1. A refractory wall structure for a metallurgical furnace, which wall structure is capable of being subjected to a high thermal loading, comprising:

a steel outer wall (1), a refractory lining (3) comprising one or more layers of a well heat-conducting material on an inside of the outer wall, and a cooler for cooling (2) the refractory wall structure, wherein the refractory wall structure also has a gap (5) and the gap has gap walls, and wherein the refractory wall structure comprises a permanent, well heat-conducting metallic filling (6) in the gap (5) in the refractory wall structure, which filling has been molten inside the gap (5) and then after solidifying is in thermal contact with the gap walls and forms a low heat resistance across the gap (5), wherein the gap (5) basically extends in parallel with the steel outer wall (1).

2. The refractory wall structure in accordance with claim 1, wherein a layer (7) is solidified onto an inside of the wall structure.

3. The refractory wall structure in accordance with claim 1, wherein the gap (5) is a gap in the refractory lining (3).

4. The refractory wall structure in accordance with claim 1, wherein the gap (5) is a gap between the steel outer wall (1) and the refractory lining (3).

5. The refractory wall structure in accordance with claim 1, wherein the cooler (2) for cooling the refractory wall structure comprises water-cooled copper cooling elements, and the gap (5) is between the refractory lining (3) and a cooling element (2).

6. The refractory wall structure in accordance with claim 1, wherein the metallic filling has a melting temperature which is lower than the process temperature.

7. The refractory wall structure in accordance with claim 6, wherein the melting temperature of the filling is higher than 200° C.

8. The refractory wall structure in accordance with claim 6, wherein the melting temperature of the filling is lower than 1,100° C.

9. The refractory wall structure in accordance with claim 1, wherein the filling has a coefficient of heat conductivity of over 15 W/m ° C.

10. The refractory wall structure in accordance with claim 1, wherein the filling is selected from the group consisting of tin, lead, zinc, aluminum, silver, copper, alloys thereof and combinations thereof.

11. The refractory wall structure in accordance with claim 1, wherein the filling is obtained during operation by melting of foil which is applied in the gap during assembly of a refractory wall structure.

12. The refractory wall structure in accordance with claim 1, wherein the filling is cast in molten state into the gap during assembly of the refractory wall structure.

13. The refractory wall structure in accordance with claim 1, wherein the filling is obtained during operation by melting metal which is applied in the gap in the form of a mass containing metal particles during assembly of the refractory wall structure.

14. The refractory wall structure in accordance with claim 1, wherein the filling is obtained during operation by melting metal in the form of one or more pellets (9) which are placed into one or more cavities in the refractory wall structure before or after commissioning of the furnace.

15. The refractory wall structure in accordance with claim 1, wherein the filling is obtained during operation by melting metal which is introduced in the form of a pumpable mass containing the metal into the refractory wall structure through a duct (8).

16. The refractory wall structure in accordance with claim 15, wherein the pumpable mass also contains an oil product.

17. The refractory wall structure in accordance with claim 15, wherein the pumpable mass also contains graphite.

18. The refractory wall structure in accordance with claim 15, wherein the pumpable mass also contains an oil product selected from the group consisting of tar, pitch or a thermosetting resin.

19. The refractory wall structure in accordance with claim 1, in which the cooler for cooling the refractory wall structure comprises water-cooled copper cooling-elements, wherein during assembly of the refractory wall structure cooling-elements are used which, at least partly, have been provided with a coating with the substance of the metallic filling.

20. The refractory wall structure in accordance with claim 1, wherein the cooler (2) for cooling the refractory wall structure are water-cooled copper cooling elements, and the gap (5) is a gap between the refractory lining (3) and a cooling element (2).

21. The refractory wall structure in accordance with claim 1, in which the means for cooling the refractory wall structure consist of water-cooled copper cooling-elements, wherein during assembly of the refractory wall structure cooling-elements are used which, at least partly, have been provided with a coating with the substance of the metallic filling.

22. The refractory wall structure in accordance with claim 1, wherein the gap (5) is at least one member selected from the group consisting of:

a gap between two layers of the refractory lining (3);

a gap between blocks or bricks of the refractory lining;

a heat crack in the material of the refractory lining;

a gap between the steel outer wall (1) and the refractory lining (3); and a gap between the refractory lining (3) and a cooling element (2) of the cooler.

23. The refractory wall structure in accordance with claim 1, wherein at least one said gap (5) is between two layers of the refractory lining (3).

24. The refractory wall structure in accordance with claim 1, wherein at least one said gap (5) is between blocks or bricks of the refractory lining.

25. The refractory wall structure in accordance with claim 1, wherein at least one said gap (5) is a heat crack in the material of the refractory lining.

26. The refractory wall structure of claim 1, wherein the gap (5) lies in a direction perpendicular to a direction of heat flow.

27. A refractory wall structure for a metallurgical furnace which wall structure is capable of being subjected to a high thermal loading, comprising:

a steel outer wall (1), a refractory lining (3) comprising one or more layers of a well heat-conducting material on the inside of the outer wall, and a cooler for cooling (2) the refractory wall structure, wherein the refractory wall structure also has a gap (5) and the gap has gap walls, and wherein the refractory wall structure comprises a permanent, well heat-conducting metallic filling (6) in the gap (5) in the refractory wall structure, which filling has been molten inside the gap (5) and then after solidifying is in thermal contact with the gap walls and forms a low heat resistance across the gap (5), wherein the gap (5) basically extends in parallel with the steel outer wall (1).

28. The refractory wall structure in accordance with claim 27, wherein the refractory lining (3) consists of one or more layers of a well heat-conducting material on the inside of the outer wall.

29. A refractory wall structure for a blast furnace with a high process temperature during operation, which wall structure is capable of being subjected to a high thermal loading, comprising:

a steel outer wall (1), a refractory lining (3) comprising one or more layers of a well heat-conducting material on the inside of the outer wall, and a cooler for cooling (2) the refractory wall structure, wherein the refractory wall structure also has a gap (5) and the gap has gap walls, and wherein the refractory wall structure comprises a permanent, well heat-conducting metallic filling (6) in the gap (5) in the refractory wall structure, which filling has been molten inside the gap (5) and then after solidifying is in thermal contact with the gap walls and forms a low heat resistance across the gap (5), wherein the gap (5) basically extends in parallel with the steel outer wall (1).

30. The refractory wall structure in accordance with claim 29, wherein the refractory lining (3) consists of one or more layers of a well heat-conducting material on the inside of the outer wall.

31. A refractory wall structure for a metallurgical furnace, which wall structure is capable of being subjected to a high thermal loading, comprising:

a steel outer wall (1), a refractory lining (3) comprising one or more layers of a well heat-conducting material on an inside of the outer wall, and a cooler for cooling (2) the refractory wall structure, wherein the refractory wall structure also has a gap (5) and the gap has gap walls, and wherein the refractory wall structure comprises a permanent, well heat-conducting metallic filling (6) in the gap (5) in the refractory wall structure, which filling has been molten inside the gap (5) and then after solidifying is in thermal contact with the gap walls and forms a low heat resistance across the gap (5), wherein the gap (5) is a gap between the steel outer wall (1) and the refractory lining (3).

32. A refractory wall structure for a metallurgical furnace, which wall structure is capable of being subjected to a high thermal loading, comprising:

a steel outer wall (1), a refractory lining (3) comprising one or more layers of a well heat-conducting material on an inside of the outer wall, and a cooler for cooling (2) the refractory wall structure, wherein the refractory wall structure also has a gap (5) and the gap has gap walls, and wherein the refractory wall structure comprises a permanent, well heat-conducting metallic filling (6) in the gap (5) in the refractory wall structure, which filling has been molten inside the gap (5) and then after solidifying is in thermal contact with the gap walls and forms a low heat resistance across the gap (5), wherein the cooler (2) for cooling the refractory wall structure comprises water-cooled copper cooling elements, and the gap (5) is between the refractory lining (3) and a cooling element (2).

33. A method of making a refractory wall structure for a metallurgical furnace, which wall structure is capable of being subjected to a high thermal loading, comprising the steps of:

assembling the refractory wall structure to comprise a steel outer wall (1), a refractory lining (3) comprising one or more layers of a well heat-conducting material on an inside of the outer wall, and a cooler for cooling (2) the refractory wall structure, and melting a permanent, well heat-conducting metallic filling (6) to be molten in a gap (5) in the refractory wall structure, and then solidifying the molten metallic filling in the gap to be in thermal contact with walls of the gap and form a low heat resistance across the gap (5), wherein the gap (5) basically extends in parallel to the steel outer wall (1).

34. The method in accordance with claim 33, wherein the filling is obtained during operation by melting of foil which is applied in the gap during assembly of a refractory wall structure.

35. The method in accordance with claim 34, wherein the filling is obtained during operation by melting metal which is introduced in the form of a pumpable mass containing the metal into the refractory wall structure through a duct (8).

36. The method in accordance with claim 33, wherein the filling is cast in molten state into the gap during assembly of the refractory wall structure.

37. The method in accordance with claim 33, wherein the filling is obtained during operation by melting metal which is applied in the gap in the form of a mass containing metal particles during assembly of the refractory wall structure.

38. The method in accordance with claim 33, wherein the filling is obtained during operation by melting metal in the form of one or more pellets (9) which are placed into one or more cavities in the refractory wall structure before or after commissioning of the furnace.

39. A method of repairing a gap in a refractory wall structure, for a metallurgical furnace, comprising a steel outer wall (1), a refractory lining (3) comprising one or more layers of a well heat-conducting material on an inside of the outer wall, and a cooler for cooling (2) the refractory wall structure, which wall structure is capable of being subjected to a high thermal loading, comprising the steps of:

melting a permanent, well heat-conducting metallic filling (6) to be molten in the gap (5) in the refractory wall structure, and then solidifying the molten metallic filling in the gap to be in thermal contact with walls of the gap and form a low heat resistance across the gap (5), wherein the gap (5) basically extends in parallel to the steel outer wall (1).

40. The method in accordance with claim 39, wherein the filling is obtained during operation by melting of foil which is applied in the gap during assembly of a refractory wall structure.

41. The method in accordance with claim 39, wherein the filling is cast in molten state into the gap during assembly of the refractory wall structure.

42. The method in accordance with claim 39, wherein the filling is obtained during operation by melting metal which is applied in the gap in the form of a mass containing metal particles during assembly of the refractory wall structure.

43. The method in accordance with claim 39, wherein the filling is obtained during operation by melting metal in the form of one or more pellets (9) which are placed into one or more cavities in the refractory wall structure before or after commissioning of the furnace.

44. The method in accordance with claim 39, wherein the filling is obtained during operation by melting metal which is introduced in the form of a pumpable mass containing the metal into the refractory wall structure through a duct (8).

* * * * *